United States Patent [19]

Downs

[11] 4,334,332

[45] * Jun. 15, 1982

[54] MOTOR-DRIVEN CAP-GRIPPER AND CAN-OPENER

[76] Inventor: Edgar S. Downs, 907 Oxford Dr., Worthington, Ohio 43085

[ * ] Notice: The portion of the term of this patent subsequent to Oct. 28, 1997, has been disclaimed.

[21] Appl. No.: 175,933

[22] Filed: Aug. 6, 1980

[51] Int. Cl.[3] ..... B25F 1/00
[52] U.S. Cl. ..... 7/150
[58] Field of Search ..... 81/3.2; 7/152, 150

[56] References Cited

U.S. PATENT DOCUMENTS

| | | | |
|---|---|---|---|
| 3,159,912 | 12/1964 | Posener | 7/152 X |
| 3,950,801 | 4/1976 | Morrison | 81/3.2 X |
| 4,230,000 | 10/1980 | Downs | 81/3.2 |

*Primary Examiner*—James G. Smith
*Attorney, Agent, or Firm*—William V. Miller

[57] ABSTRACT

A kitchen appliance including a cap-gripper and a can-opener actuated by the same motor. The cap-gripper includes relatively movable jaws which are moved by a screw driven by the motor which is automatically stopped when the jaws come together. The can-opener is driven directly by the motor but a clutch is provided for interrupting the drive to the screw each time the can-opener is selectively actuated.

9 Claims, 7 Drawing Figures

MOTOR-DRIVEN CAP-GRIPPER AND CAN-OPENER

BACKGROUND OF THE INVENTION AND BRIEF DESCRIPTION

In the copending application Ser. No. 060,779, filed July 26, 1979 now U.S. Pat. No. 4,230,000 of Oct. 28, 1980, there is disclosed a kitchen appliance in the form of a cap-gripper for use in removing caps from jars, which includes relatively movable clamping jaws and a motor-driven screw for moving the jaws between clamping and non-clamping positions. It has been found desirable to provide a can-opener in combination with this cap-gripper so that the combination appliance can either open jars or cans. It is desirable to drive the can-opener from the same electric motor but some arrangement must be provided to disconnect the cap-gripper from the motor when the can-opener is operated.

BRIEF DESCRIPTION OF THE DRAWINGS

The best mode contemplated in carrying out this invention is illustrated in the accompanying drawings in which.

DETAILED DESCRIPTION OF THE INVENTION

Figure 1:
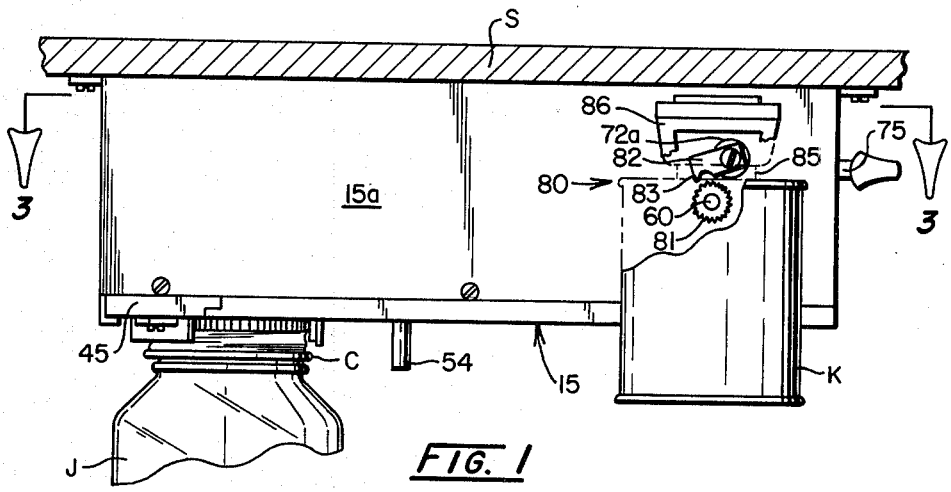
FIG. 1 is a side elevational view of the combination cap-gripper and can-opener kitchen appliance.
Figure 3:
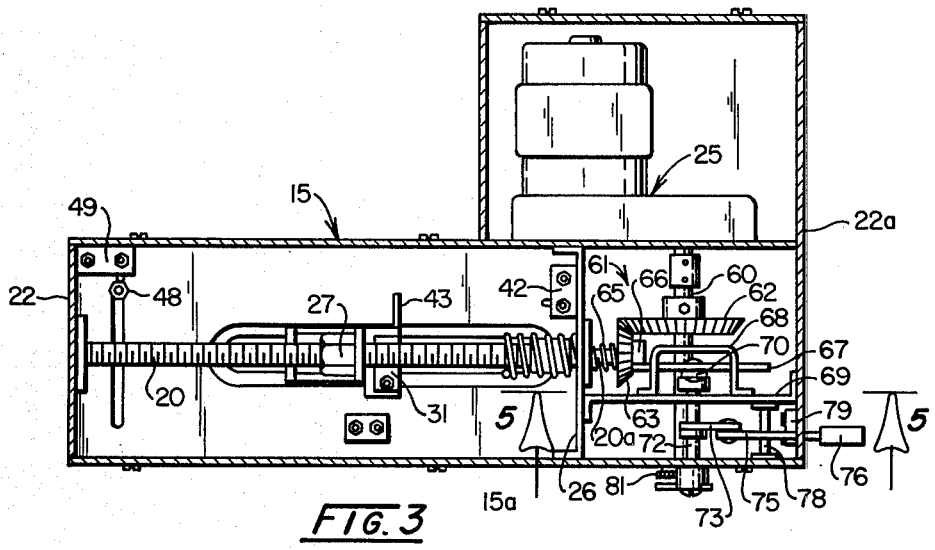
FIG. 3 is a horizontal sectional view taken along line 3—3 of FIG. 1.
Figure 4:
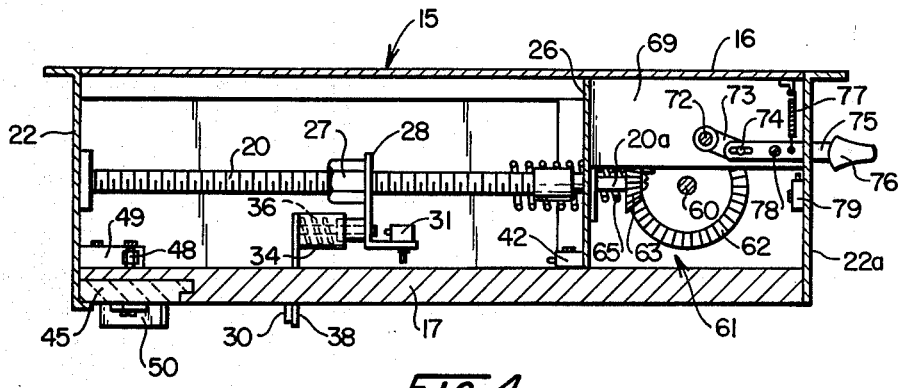
FIG. 4 is a vertical sectional view taken along line 4—4 of FIG. 2.

As disclosed in said application Ser. No. 060,779, and as shown in FIG. 1, the cap-gripper includes an elongated housing 15 suspended from a support S which, for example, could be the underside of a kitchen counter. A jar J is shown suspended by its screw cap C as an example of the use of the gripper. Rotatably mounted within the housing 15 and extending longitudinally thereof, as shown in FIGS. 3 and 4, is a feed-screw 20. This screw is rotatably mounted by one end wall 22 and an intermediate transverse wall 26 of housing 15, and receives a nut 27 threaded thereon which carries a depending support bracket 28 which is part of the assembly adapted to mount the movable jaw 30 of the cap-clamping means. This assembly also includes lower bracket 38 with spring 36 therebetween. The screw 20 is driven by a combined reversible electric motor and gear reduction unit 25.

A limit switch 28 is carried by the bracket 28 as indicated in said copending application to limit the force of engagement of movable jaw 30 and V-arranged clamps or jaws 50 which are carried on the lower surface of slide 45. Another limit switch 42 is engaged by a lug 43 as the motor unit 25 reverses the screw 20 to stop the motor in its retracting movement of the jaw 30.

As further disclosed in said copending application, the transverse slide 45 is preferably transparent and is mounted in a bottom plate 17 of housing 15 for transverse reciprocation and when in its innermost position, engages a limit switch 49, by means of a bolt 48 thereon, which starts the clamping operation. Adjacent the slide 45, is a push-button start switch 54 which can be engaged to release the cap-clamp.

Figure 5:
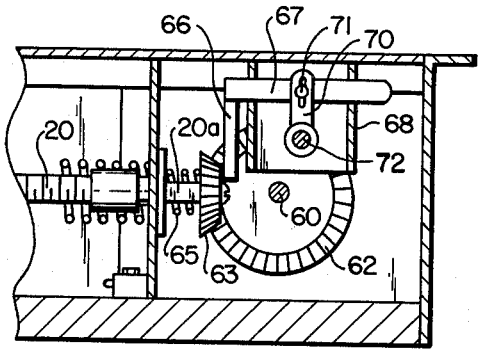
FIG. 5 is a vertical sectional view taken along line 5—5 of FIG. 3.
Figure 6:
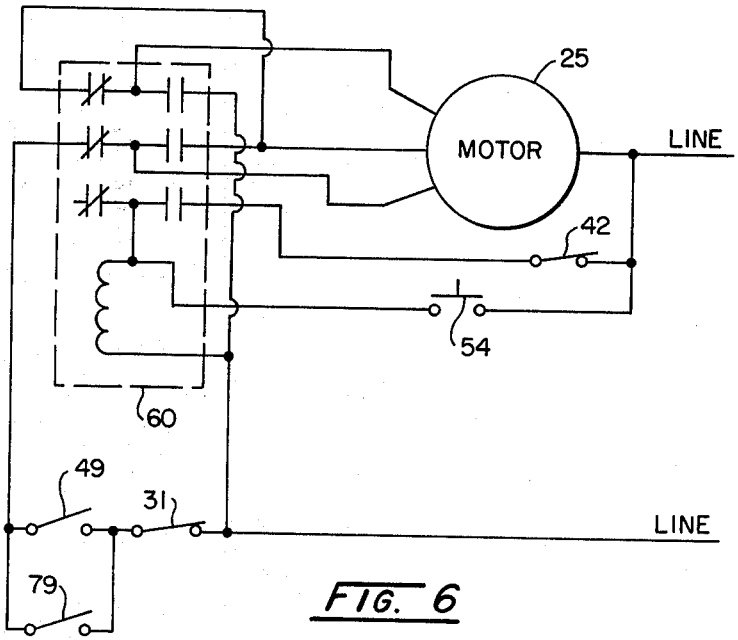
FIG. 6 shows an electric circuit for the appliance.

According to this invention, the screw 20 is driven from the motor and gear unit 25, as shown in FIGS. 3, 4 and 5 through a gear clutch unit 61. This unit comprises a bevel gear 62 keyed on the shaft 60. The shaft 60 is driven directly by the motor and gear unit 25. Cooperating with the bevel gear 62, is a bevel pinion 63 which is movable into-and-out of meshing relationship therewith. This pinion is nonrotatably on but axially movable on an extension **20*a* of the screw 20. This extension is square and the pinion 63 is slidably fitted thereon. The pinion 63 is normally held engaged with the gear 62 by a compression spring 65 surrounding the square shaft extension 20*a* and disposed between the pinion and intermediate wall 26**.

The pinion 63 is disengaged from the gear 62 by means of a rigid depending shifting arm 66 which is carried by a reciprocably mounted slide 67 carried in guide openings in a U-shaped bracket 68 that is carried by a vertical partition 69 disposed in the housing 15 parallel to the front or outer wall **15*a* thereof. The slide 67 is reciprocated by means of a rocker arm 70 which has its upper end connected to it by a pin-and-slot connection 71 and is keyed to a rock shaft 72. Shaft 72 extends forwardly parallel to shaft 60 at a higher level and is mounted for rotation in the partition 69 and front wall 15*a*. The shaft 72 is rocked by means of a rocker arm 73 keyed thereto and connected at its outer end by a pin-and-slot connection 74 to an actuating lever 75. The lever 75 extends through a vertical slot in the adjacent end wall 22*a* of the housing 15 and has a finger-engaging portion 76. The lever 75 is pivoted intermediate its ends on a pivot pin 78 supported by a partition 69 and wall 15*a*. A tension spring 77 is connected, between lever 75 and the top 16, of the housing 15 to normally keep the outer end of lever 75 upwardly and, therefore, the gear clutch 61 engaged. However, when the clutch is to be disengaged, the lever 75 is pushed downwardly by portion 75, and as the lever 75 swings downwardly, it rocks arm 73 upwardly, and rock shaft 72 counterclockwise (FIG. 4) which, in turn, rocks arm 70 inwardly and upwardly (FIG. 5) to move slide 67 axially inwardly of screw 20 to slide the pinion 63 inwardly on the square part 65 of the screw and disengage the pinion from the gear 62. Thus, the clutch 61 is disengaged by the actuation of lever 75 and the drive from the motor unit 25 to the cap-clamp actuating screw 20 is interrupted. As soon as lever 75 is released, the clutch 61 will be re-engaged. Directly below the lever 75 in housing 15 on wall 22*a* is a control switch 70 which is closed to start motor unit 25** whenever the lever is pushed downwardly.

Figure 2:
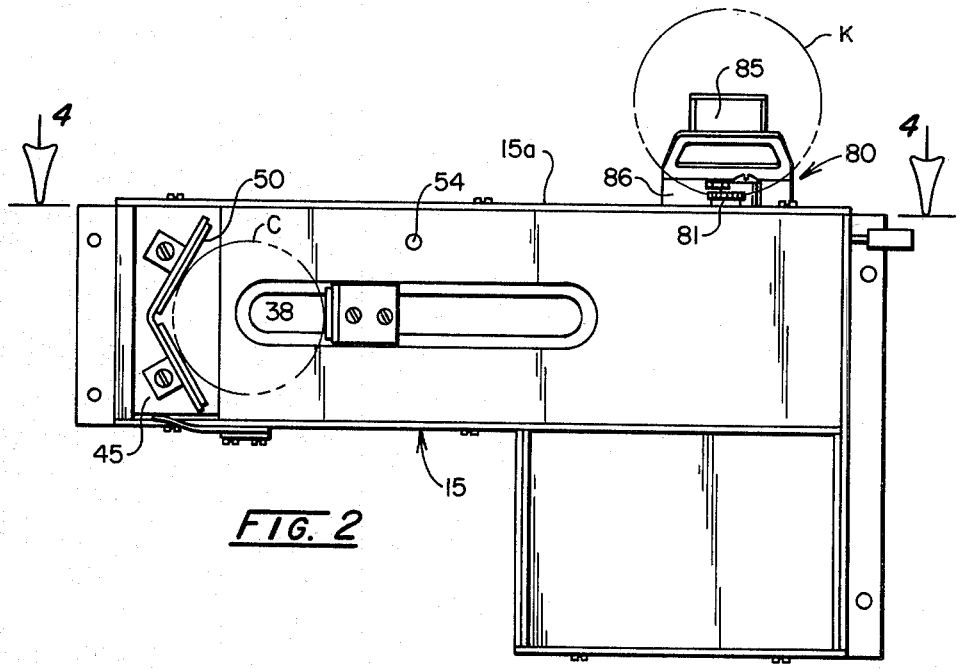
FIG. 2 is a bottom view of the appliance.

The can-opener unit 80 will be of the usual type and will be mounted outside the front wall **15*a* of the housing. As a part of the can-opener, the shaft 60 is continued on out through the front wall 15*a* of a housing 15. At its outer end the shaft has the drive cog wheel 81 of the can-opener keyed thereon for rotation therewith (FIGS. 1 to 3). Directly above the drive cog wheel 81 and mounted for rocking movement with the shaft 72 is the cutting blade 82 of the can-opener. The blade 82 is of the usual shape with a cutting end 83 and straight side edges which fit in a slot 84 in the end of shaft 72**, the blade being removably held therein by means of a screw 72*a*. Pushing lever 75 downwardly swings blade 82 downwardly into contact with the top of can K, the lip L of which will be engaged by driver wheel 81. The usual magnet 85 is supported by a bracket 86 attached to the front plate 15*a* of the housing 15.

Figure 7:
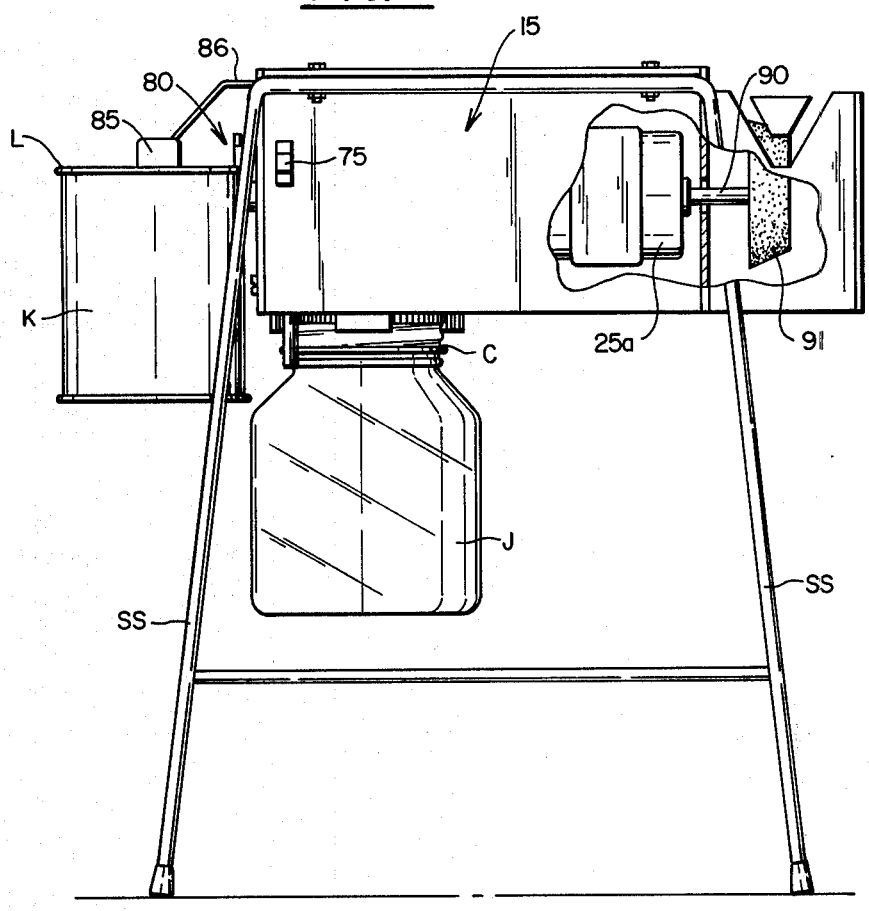
FIG. 7 is an elevational view, partly broken away, of the appliance supported by a stand and with the motor also driving a knife-sharpening wheel.

The electric circuit of FIG. 7 will actuate the combined cap-gripper and can-opener. It includes the circuit of the copending application plus the on-and-off control switch 79 connected in the circuit in parallel with switch 49. The circuit includes the motor 25, the start switch 49, the limit switch 31, the push-button switch 54*a*, holding relay 60, and a limit switch 42, all referred to in said application. To use the can-opener 80, it is merely necessary to push down on lever 75 and actuate switch 79 to actuate motor unit 25 to directly drive the can-opener unit 80. Before the motor is engaged, the clutch unit 61 is disengaged so there will be no danger of damage to bevel gears 62 and 63. Sine the clutch is disengaged, the drive to the cap-clamp actuating screw 20 from the motor unit 25 is interrupted and, therefore, the clamps 38 and 50 will not be moved together, which would cause automatically shutting off of the motor by switch 31. This switch may be eliminated if the motor is impedance equipped.

When used as a cap-gripper, the appliance will function exactly as described in the copending application. Assuming the motor unit 20 is stopped, the jaw 30 is retracted and the slide 45 is in its outermost position, the jar J will be slipped beneath the slide and laterally so that the cap C will move into the diverging jaws 50, and then the slide will be pushed inwardly to the position shown in FIG. 2. This causes the bolt 48, carried by the slide, to contact the switch 49 and energize motor unit 25, starting screw 20 to move the jaw 38 towards jaws 50 until the cap is engaged and clamped, the engagement being with a resilient force because of spring 36. Engagement will be limited by switch 31 which will de-energize the motor unit. When the cap is to be released, the switch 54 can be actuated manually to reverse the motor rotation and move clamp jaw 30 away from clamp jaws 50. During operation of the cap-gripper in this manner, the clutch 61 is engaged and the shaft 60 is rotated. However, rotation of this shaft does not affect the can-opener unit 80 except to drive the wheel 81 which is not objectionable. In FIG. 7, there is illustrated a cap-gripper carried in a housing 15 exactly as previously described and having a can-opener unit 80 at the front thereof. However, in this case, instead of being suspended from beneath a counter or other support S, it is suspended within a self-support stand SS which may be of any suitable construction. In addition, the motor unit 25*a* has a drive shaft 90 extending from its rear side which may carry an abrasive wheel 91 for sharpening knives or other purposes. Whenever the motor unit 20 is energized, this shaft 90 will also rotate.

It will be apparent that this invention provides a kitchen appliance including a cap-gripper and a can-opener actuated by the same motor for the sake of economy. The cap-gripper includes relatively movable jaws which are moved by a screw driven by a motor which is automatically stopped when the jaws come together. The can-opener drive wheel is driven directly by the motor. However, to make it practical to drive the can-opener from the same motor, the drive to the screw is interrupted each time the can-opener is selectively actuated.

Having thus described this invention what is claimed is:

1. An appliance comprising a jar cap-gripper and a can-opener actuated by the same electric motor, said cap-gripper comprising relatively movable jaws which are moved between clamping and non-clamping positions relative to a cap inserted therebetween, a drive for moving said jaws relatively by said motor, a can-opener including a driver wheel driven directly from said motor, said can-opener also including a cutting member movable into cooperative relationship with the driver wheel, can-opener actuating means for moving the cutting member into said relationship, a clutch normally engaged to complete the drive from said motor to said cap-gripper but being capable of disengagement to interrupt the drive to said cap-gripper from said motor, said clutch being disengaged by actuation of said can-opener actuating means.

2. An appliance according to claim 1 in which the clutch-controlled drive includes a screw operatively connected to the movable jaws.

3. An appliance according to claim 2 in which said can-opener actuating means comprises a pivoted actuating lever and said clutch has yieldable means for keeping it normally engaged, a reciprocable slide having a clutch disengaging arm, and means for operatively connecting the actuating lever to the slide.

4. An appliance according to claim 3 including a switch connected in a central circuit of the motor for starting the motor engaged by the actuating lever when moved into can-opener actuating position.

5. An appliance according to claim 4 in which the clutch comprises a bevel pinion mounted on the screw for axial but non-rotative movement thereon, a bevel gear carried by a shaft driven directly by said motor, and a spring on the screw normally keeping the bevel pinion engaged with the bevel gear but movable out of engagement therewith against the force of the spring by the clutch-disengaging arm.

6. An appliance according to claim 5 in which the shaft carries the driving wheel of the can-opener.

7. An appliance according to claim 6 in which the actuating lever of the can-opener is normally held is non-actuating position by a spring connected thereto.

8. An appliance according to claim 3 in which the actuating lever and slide arm connecting means includes a rock shaft which carries the cutting member of the can-opener in the form of a blade mounted on said rock shaft for swinging about the axis thereof into-and-out of cooperative relationship with said driver wheel, a rocker arm keyed to said shaft and pivoted to said actuating lever and a second rocker arm keyed to said shaft and pivoted to said reciprocable slide.

9. An appliance according to claim 4 in which the circuit also includes a start switch connected in said circuit and mounted on the cap-gripper to start the motor to drive the screw, and stop means connected in said circuit to stop the motor and interrupt the drive of the screw when the jaws reach cap-clamping condition.

* * * * *